US010858164B2

(12) United States Patent
Hyun

(10) Patent No.: US 10,858,164 B2
(45) Date of Patent: Dec. 8, 2020

(54) PACKING BOX FOR QUICK DISPLAY

(71) Applicant: DOYO ENGINEERING CO., LTD., Bucheon (KR)

(72) Inventor: Kang Ho Hyun, Bucheon (KR)

(73) Assignee: DOYO ENGINEERING CO., LTD., Bucheon (KR)

( * ) Notice: Subject to any disclaimer, the term of this patent is extended or adjusted under 35 U.S.C. 154(b) by 315 days.

(21) Appl. No.: 15/987,404

(22) Filed: May 23, 2018

(65) Prior Publication Data

US 2018/0339827 A1 Nov. 29, 2018

(30) Foreign Application Priority Data

May 24, 2017 (KR) ..... 10-2017-0064133

(51) Int. Cl.
*B65D 77/04* (2006.01)
*B65D 5/50* (2006.01)
*B65D 5/49* (2006.01)

(52) U.S. Cl.
CPC ..... *B65D 77/0433* (2013.01); *B65D 5/48024* (2013.01); *B65D 5/48026* (2013.01); *B65D 5/48046* (2013.01); *B65D 5/504* (2013.01); *B65D 5/5085* (2013.01)

(58) Field of Classification Search
CPC ..... B65D 77/0433; B65D 5/52; B65D 5/526; B65D 5/5266; B65D 5/48024; B65D 5/48026; B65D 5/48046; B65D 5/504; B65D 5/48012; B65D 5/48036; B65D 5/5085
USPC ..... 206/756, 740–744, 765, 45.2, 736; 229/120.23, 120.06, 120.35, 120.38
See application file for complete search history.

(56) References Cited

U.S. PATENT DOCUMENTS 3,152,687 A * 10/1964 Goldstein ..... B65D 5/526 206/745
5,979,662 A * 11/1999 Green ..... B65D 5/5021 206/463
6,386,371 B1 * 5/2002 Parsons ..... B65D 5/504 206/485
6,427,842 B1 * 8/2002 Green ..... B65D 5/5021 206/497

(Continued)

FOREIGN PATENT DOCUMENTS

JP 11035031 2/1999
JP 2007022603 2/2007

(Continued)

*Primary Examiner* — Rafael A Ortiz
(74) *Attorney, Agent, or Firm* — Cantor Colburn LLP

(57) ABSTRACT

A packing box for quick display including a first box body having a lower substrate with a plurality of seat portions each having an insert slit for a lower insert portion of packaged goods that have a panel type external insert portion on each of upper and lower sides, and a wall provided to surround the outside of the lower substrate. The wall includes a sidewall having an inclined portion configured to expose the packaged goods. The first box body is formed to realize a function of stable storage and stable transfer of goods, and increases convenience because it can display the goods in a packaged state without displaying the packaged goods one by one on a different display stand. The seat portion can maintain a normal state of each packaged goods and prevent collision of the packaged goods.

3 Claims, 11 Drawing Sheets

(56) References Cited

U.S. PATENT DOCUMENTS

| | | | | |
|---|---|---|---|---|
| 2006/0086779 | A1* | 4/2006 | Meyer | B65D 5/48038 229/120.32 |
| 2006/0124713 | A1* | 6/2006 | Bos | B65D 5/48038 229/120.36 |

FOREIGN PATENT DOCUMENTS

| | | |
|---|---|---|
| JP | 2016140704 | 8/2016 |
| KR | 19990034785 | 9/1999 |
| KR | 20120056961 | 6/2012 |
| KR | 20120103210 | 9/2012 |
| KR | 101300468 | 8/2013 |

* cited by examiner

PACKING BOX FOR QUICK DISPLAY

CROSS REFERENCE TO RELATED APPLICATION

The present application claims priority to Korean Patent Application No. 10-2017-0064133, filed May 24, 2017, the entire contents of which is incorporated herein for all purposes by this reference.

BACKGROUND OF THE INVENTION

Field of the Invention

The present invention relates generally to a packing box for quick display. More particularly, the present invention relates to a packing box for quick display, the packing box including a first box body that is formed to realize a function of stable storage and stable transfer of goods, and increases convenience because it can display the goods in a packaged state without displaying the packaged goods one by one on a different display stand, and includes a seat portion for maintaining a normal state of the packaged goods and for preventing collision of the packaged goods, especially for quickly displaying fishing reels.

Description of the Related Art

Generally, various packing boxes are proposed that satisfy efficiency of storage and simultaneous display.

For example, in the related art, there is Korean Utility Model Application Publication No. 20-1999-0034785 (date of publication, Sep. 6, 1999) entitled "Packing box having combined purpose of displaying ballpoint pens for sale".

In this published device, a packing box displays ballpoint pens in which a plurality of pens are transported and stored in an upright packaged state, whereby a lid of the packing box can be opened to display the pens for selling in a packaged state.

In the packing box, a plurality of holes is perforated on a front of the box to form a perforation surface and a folding flap is formed on an outside of the perforation surface by extending a front of a box body, whereby the folding flap is folded and inserted inside the box body. By extending integrally a pad portion that can hold a pen upright from a front of the box body, it is applicable to a device that is easy to manufacture, reduces cost, and prevents sagging of the box body by using a pad and a part of the folding flap of the perforation surface as a front of the box body.

Another example is disclosed in Korean Patent Application Publication No. 10-2012-0056961 (date of publication Jun. 5, 2012) entitled "Box for packing and displaying goods". This document proposes a box for packing and displaying goods, in which when displaying goods at a store, unit packing as well work to take goods out of the packing box and displaying each item is eliminated by allowing the packing box to be separated into a lower part and an upper part, and also displayed goods are accommodated in the packing box that can prevent spoiling of an appearance such as disordering of the goods. Accordingly, inconvenience of store worker often checking goods is eliminated, since the goods can be completely separated from other goods when being displayed and can be prevented from mixing with other goods. Thus, consumers are easy to select goods.

Moreover, Korean Patent Application Publication No. 10-2012-0103210 (date of publication Sep. 19, 2012) discloses "Packing box serving as display box for inclined display of goods". This packing box includes a cut and bending type incline seat slice that is bent on a back plate of a lower display box and is supported on a lower plate in the display box, whereby it is possible to stably display goods regardless of quantity of the goods due to the incline seat slice which is supported stably on the floor when displaying the goods while realizing the inclined display of the goods, especially, the front of goods is displayed in a state of inclined display within an angle easily viewed by a consumer. Thus, it is possible for consumers to easily identify the goods.

As a result, the goods can be displayed in the lower displaying box without taking out the goods from the packing box, and stable display of the goods can be achieved by the incline seat slice supported stably on the floor.

Furthermore, Korean Patent No. 10-1300468 (date of publication Oct. 21, 2013) discloses "Packing box for transport and display of goods". The technique disclosed in this document is configured to integrate a packing box with a lid into a single body to store and display goods. This technique also provides a packing box that can realize transport and display of goods, and can easily display goods only by assembling a lid. In addition, assembling of cardboard, which is deployed in every direction, is performed so that bottom, front, left, and right sides and a back side are sealed. The cardboard packing box includes: a box body having a storage space portion formed inside the front for storing goods; a goods storage stand inserted into the storage space portion, so as to store goods; a lid formed to open and close an upper portion of the storage space portion; and a handle strap provided on each of the box body and the lid for transporting, wherein the lid is formed to be connected to the box body into a single body. Here, the lid is assembled to be inserted into the storage space portion so that the goods can be displayed immediately, whereby the lid improves effects of convenience in storage or transport of goods since the lid is connected to the box body into a single body.

These conventional references all propose a packing box suitable for specific goods, and the present invention is intended to provide a packing box that can satisfy a storage, transport, and display function, especially for a fishing reel. More particularly, the present invention provides sidewalls of a second box body inclined for immediate display of an individually packed fishing reel, whereby it is possible to prevent shaking of the packaged goods and prevent mixing and collision of packaged goods by having an insert slit on a seat portion of a substrate. Thus, the present invention is clearly different from the related art in which the present invention provides a packing box having an asymmetric seating structure of a lower substrate suitable for fishing reels having respective handles.

SUMMARY OF THE INVENTION

Therefore, it is an objective of the present invention to provide a packing box for quick display that can realize efficient storage and transport of goods, the packing box including a first box body having a sidewall incline portion configured to increase convenience of displaying goods in a packaged state without displaying the packaged goods one by one on a separate showcase, and a seat portion for maintaining a normal state of packaged goods while preventing collisions of the goods.

Another objective of the present invention is to provide a packing box for quick display, wherein a plurality of seat portions of a lower substrate is arranged at front and back sides to compose one set, and partition walls are arranged between a plurality of seat portions to ensure orderly and dense storage and display of goods.

A further objective of the present invention is to provide a packing box for quick display, wherein a cut-off slot is formed in a partition wall of the packing box, and a wedge panel is coupled to the cut-off slot to lid an upper insert portion of each of packaged goods, thereby preventing shaking, mixing, and collision of individually packaged goods during storage and transport.

Still another objective of the present invention is to provide a packing box in which the first box body further includes a first lid to improve storage stability of packaged goods, especially, when the packaged goods are fishing reels and, more particularly, each of the packaged goods is an individually packaged fishing reel, wherein the packing box has an asymmetric seat portion structure of a lower substrate suitable for characteristics of fishing reels having respective handles.

To achieve the above objectives, a packing box for quick display according to the present invention includes: a first box body having: a lower substrate provided to pack packaged goods each having a panel type external insert portion on each of upper and lower sides thereof, the lower substrate having a plurality of seat portions each having an insert slit in which a lower external insert portion of each of the packed goods; and a wall provided to surround an outside of the substrate, and including a sidewall having an inclined portion configured to expose the packaged goods.

In the packing box for quick display, the plurality of seat portions of the substrate may be arranged to form one set in which multiple seat portions are arranged in front and rear parts of the substrate, the seat portion set being configured as two or more sets on left and right sides, with a partition wall provided between the seat portion sets.

Further, a cutoff slot corresponding to the insert slit of each of the seat portion may be formed on an upper portion of the partition wall, and a wedge panel covering an upper insert portion of each of the packaged goods may be joined on the cutoff slot.

The wall of the first box body may include a back wall connecting both sidewalls, the first box body may include a first lid which covers upper portions of the back wall and the sidewalls in a form of receiving the upper portions, and the packing box may further include an external second box body receiving the first box body and the first lid.

The packing box for quick display according to the present invention, includes: a first box body having a sidewall incline portion configured to increase convenience of displaying goods in a packaged state without displaying packaged goods one by one on a separate showcase; a seat portion included for maintaining a normal state of individually packaged goods and preventing collision thereof; multiple seat portions of a lower substrate arranged at front and back side to compose one set; and partition walls provided between a plurality of sets of seat portions to ensure orderly and dense storage and display, wherein a cutoff slot is formed in the partition wall, and a wedge panel is coupled to the cutoff slot to lid an upper insert portion of each of the packaged goods, thereby preventing shaking, mixing, and collision of individual packaged goods during storage and transport. The first box body further includes a first lid to improve storage stability of the packaged goods, especially, when the packaged goods are fishing reels and, more particularly, when the packaged goods are individually packaged fishing reels, so that the present invention can provide the seat portion structure of a lower substrate having an asymmetric structure suitable for characteristics of fishing reels having respective handles.

DETAILED DESCRIPTION OF THE INVENTION

The present invention is described in detail with reference to the accompanying drawings.

The present invention will now be described in detail based on aspects (or embodiments). The present invention may, however, be embodied in many different forms and should not be construed as being limited to only the embodiments set forth herein, but should be construed as covering modifications, equivalents or alternatives falling within ideas and technical scopes of the present invention.

Also, for convenience of understanding of the elements, in the figures, sizes or thicknesses may be exaggerated to be large (or thick), may be expressed to be small (or thin) or may be simplified for clarity of illustration, but due to this, the protective scope of the present invention should not be interpreted narrowly.

The terminology used herein is for the purpose of describing particular aspects (or embodiments) only and is not intended to be limiting of the present invention. As used herein, the singular forms are intended to include the plural forms as well, unless the context clearly indicates otherwise.

It will be further understood that the terms "comprises", "comprising", "includes", and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

Detailed descriptions of known functions and components incorporated herein will be omitted when it may make the subject matter of the present invention unclear.

Terms such as 'a first ~' and 'a second ~' are used only for the purpose for distinguishing a constitutive element from other constitutive element, but constitutive element should not be limited to a manufacturing order, and the terms described in the detailed description of the invention may not be consistent with those described in the claims.

Figure 1A:
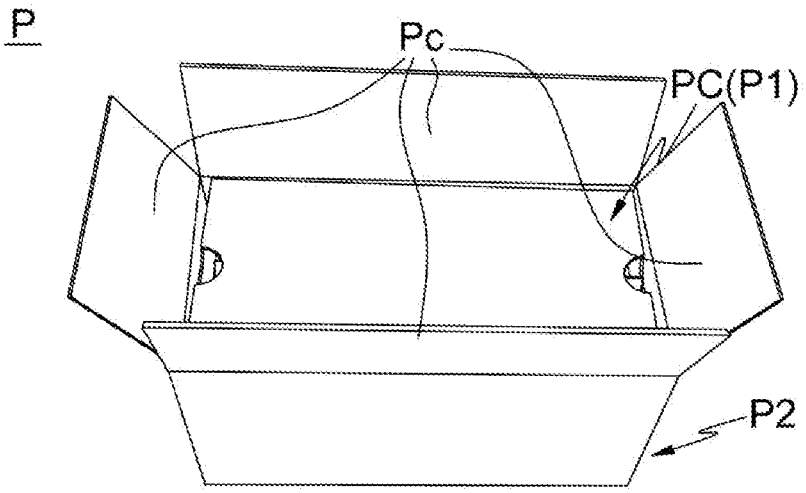
FIGS. 1A, 1B, and 1C are photographs that can substitute drawings of an internal first box body and an external second box body composing a packing box for quick display according to the present invention
Figure 2A:
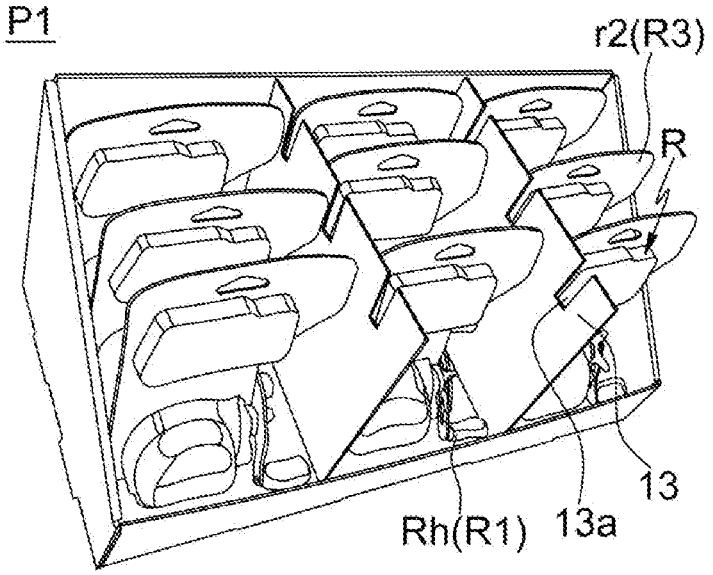
FIGS. 2A, 2B, 2C, FIGS. 3A and 3B, and FIGS. 4A, 4B and 4C are photographs that can substitute drawings of a major part of the internal first box body composing the packing box for quick display according to the present invention.
Figure 2B:
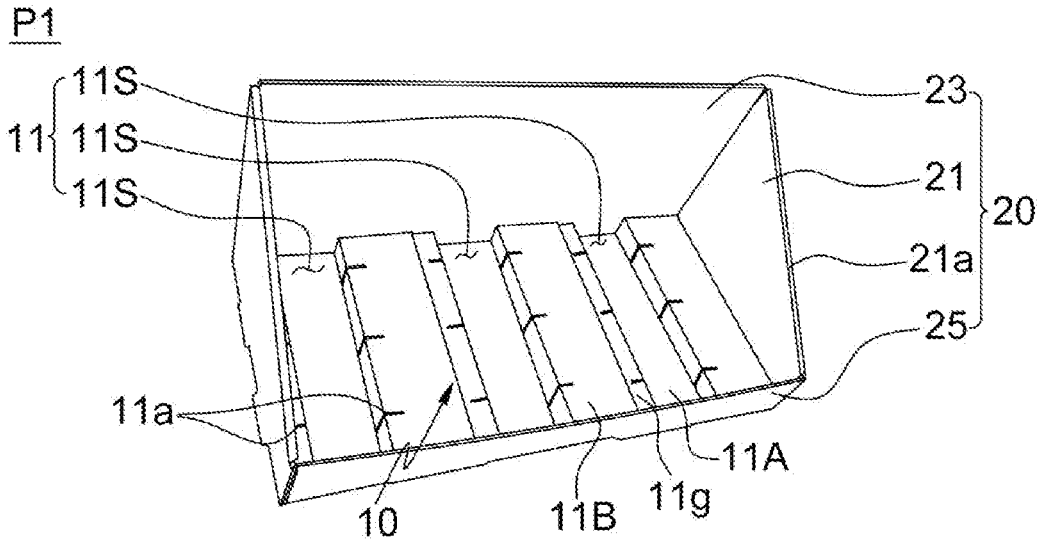
Figure 2C:
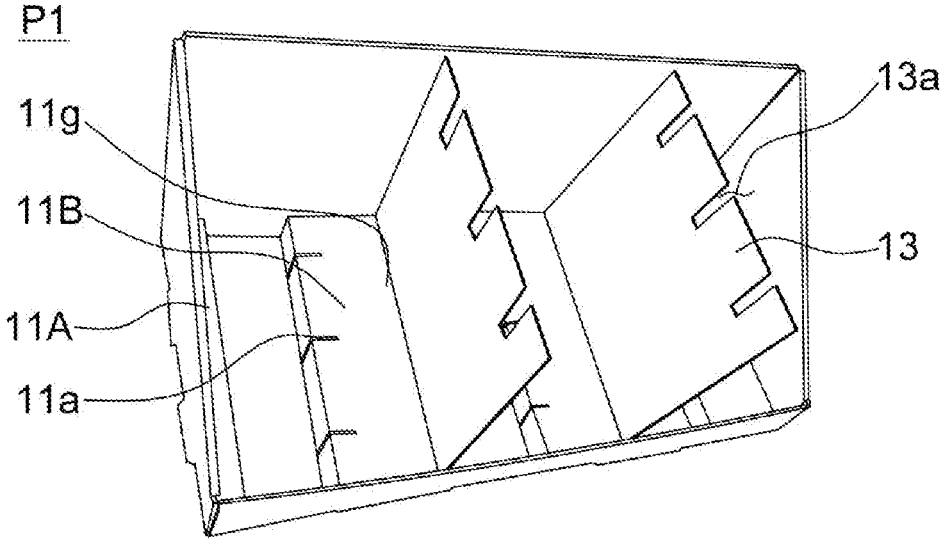
Figure 3A:
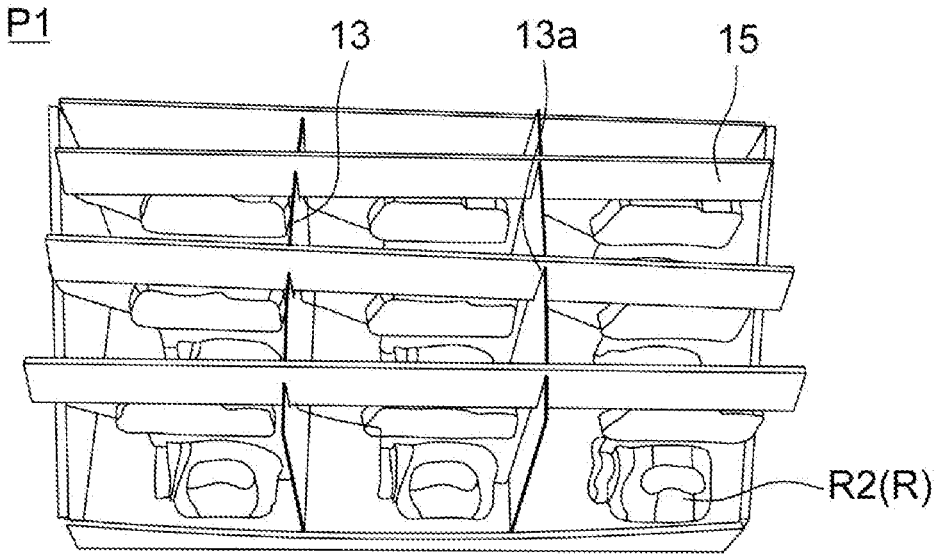
Figure 3B:
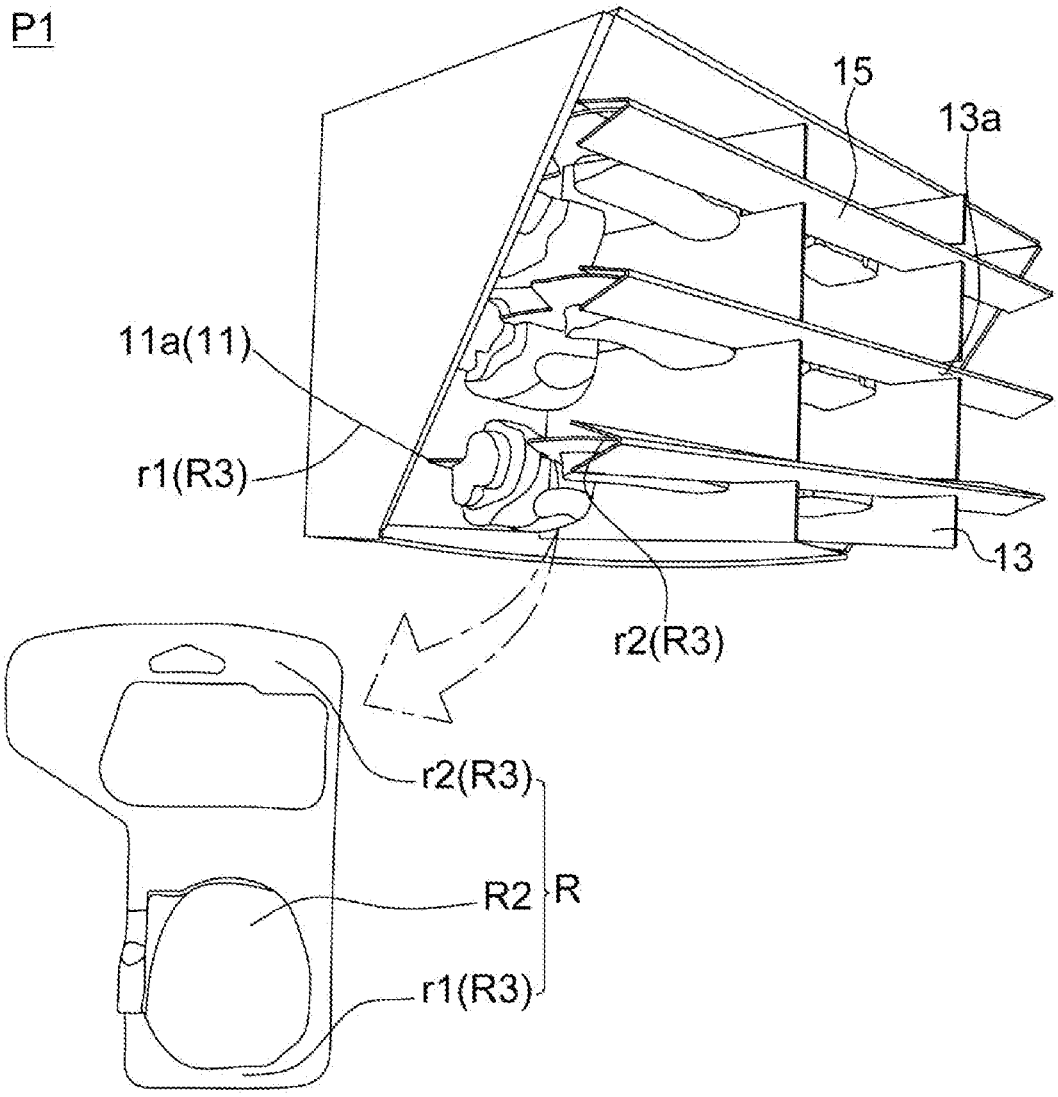

For convenience of the description of a packing box for quick display P according to the present invention, when an approximate direction rather than a precise direction is specified with reference to FIG. 1A or FIG. 2C, up and down directions right, left directions and front and back directions are determined based on a state as it is showing. This standard may be also applied to the other drawings, and directions may be specified and described based on this standard unless the detailed description of the invention and the claims specially indicate otherwise.

Figure 1B:
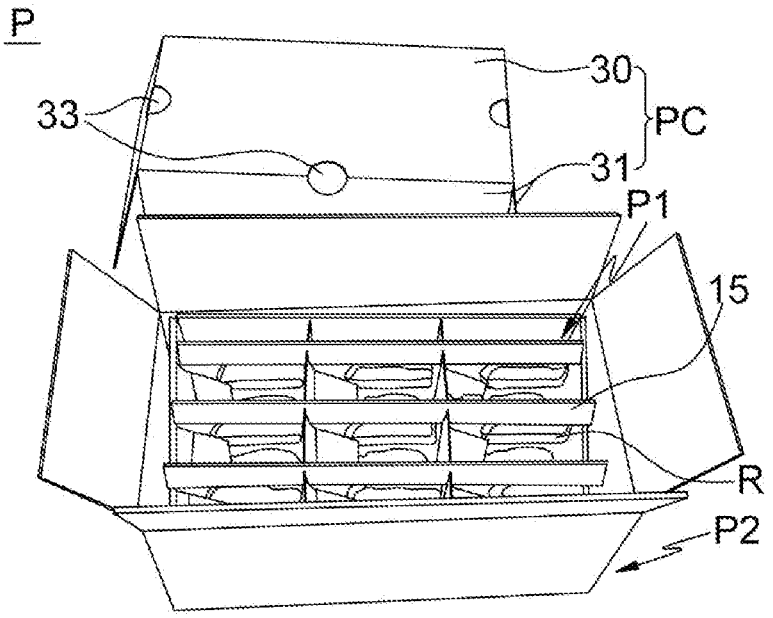
Figure 1C:
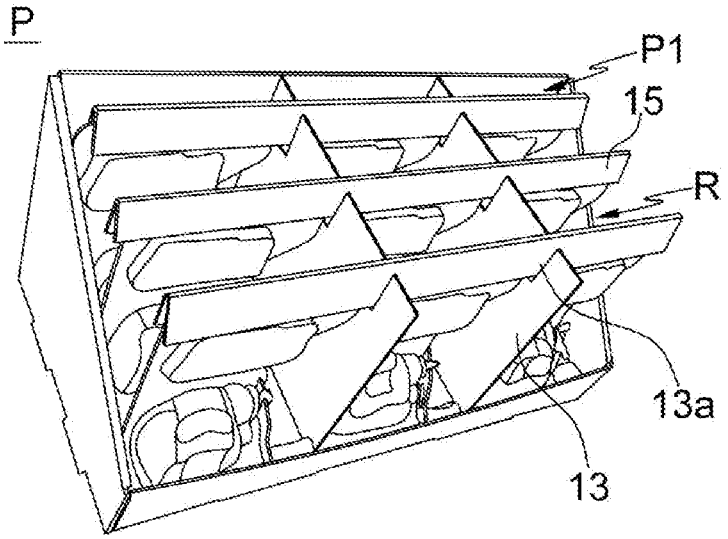

First, as shown in FIGS. 1A to 1C, the packing box for quick display according to the present invention has an internal first box body P1 as a core part and may further include an external second box body P2 as required (considering storage and transport convenience).

The second box body is a structure in which front-back and left-right pieces of a lid of lower and upper portions are coupled and fixed by a tape like an ordinary packing box, and for convenience, only an upper second lid is indicated with a reference mark.

As it will be ascertained in FIGS. 1A to 4C that can substitute drawings, FIGS. 5A to 5F that correspond to a cutting line drawing of various components in a case of manufacturing a first box body by using a Thomson mold (in FIG. 5A or 5B), a dotted line corresponds to a folding line, a solid line corresponds to a cutting line, and a hatched area corresponds to an area (PB, refer to FIG. 5A) of a joint member (bond, double sided tape, glue, etc.), A first box body P1 installed in a second box body P2 includes a lower substrate 10 (refer to FIG. 2B) and a wall body 20, and a first lid (PC) is covered so as to secure functions of preventing shaking, mixing, collision of internal individually packaged goods R.

Figure 5A:
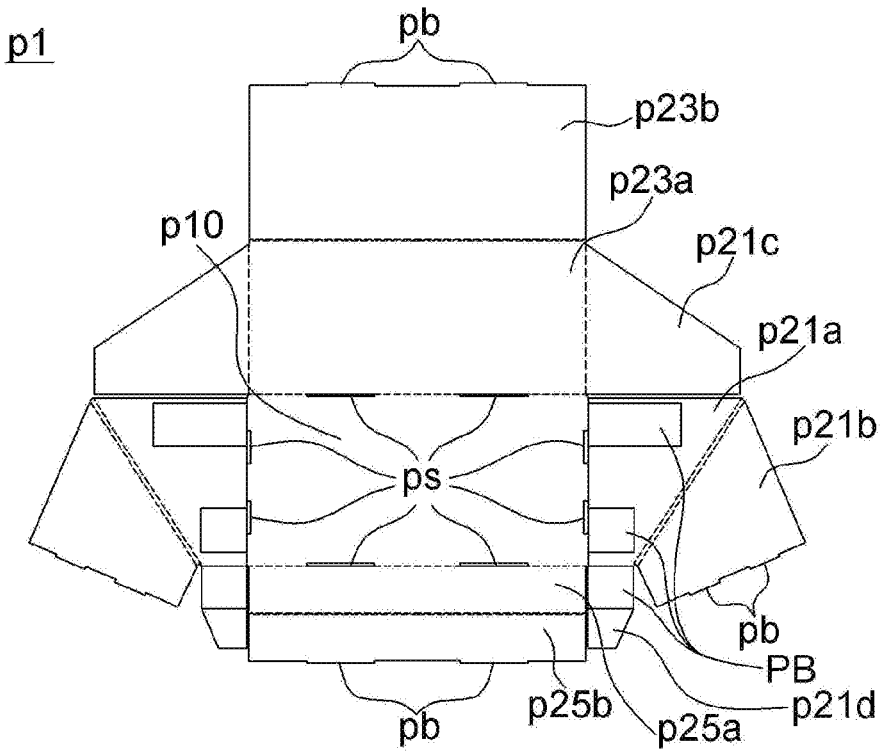
FIGS. 5A, 5B, 5C, 5D, 5E, and 5F are views for cutoff lines of various components when manufacturing a first box body by using a Thomson mold.
Figure 5B:
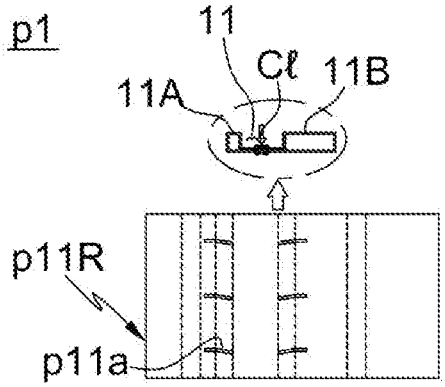
Figure 5C:
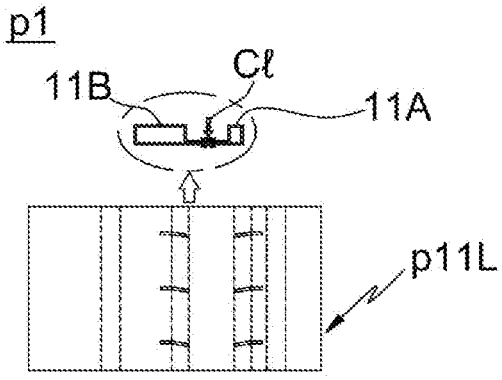
Figure 5D:
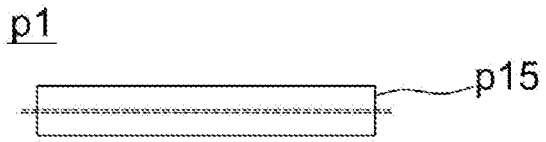
Figure 5E:
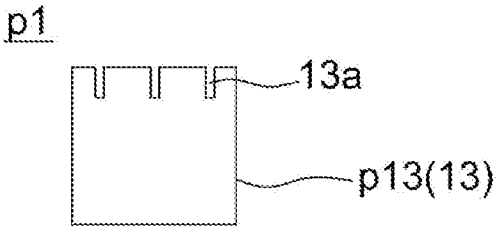
Figure 5F:
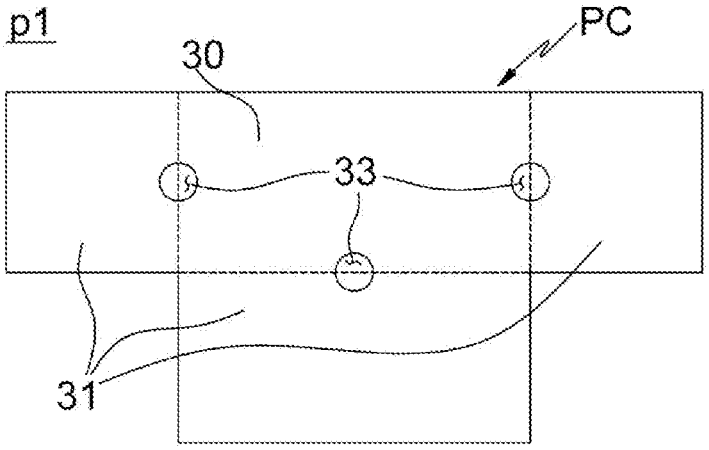

As shown in FIGS. 1B and 5F, the first lid PC has an insert portion 33 on left, right and front sides connected to an upper lid portion 30. The lid portion 30 covers an upper surface of the first box body P1, and the insert portion 33 is inserted between the second box body P2 and a wall 20 of the first box body.

An insert portion 33 is formed at a boundary between the lid portion 30 and each of the insert portions 33 to serve as a handle for separating the first lid PC, and also serve as an observation window for confirming the internal packaged goods R when a second lid PC of the second box body P2 is opened.

In particular, in the first box body P1, the lower substrate 10 includes a plurality of seat portions 11 each having an insert slit 11*a* for a lower insert portion r1 of the packaged goods R having a panel type external insert portion R3 (refer to FIGS. 2A, 3A, 3B, 4C, etc.) on a top and bottom. The substrate 10 is connected to a wall 20, and a sidewall provided to surround an outside of the substrate having an inclined portion 21*a* configured to expose the packaged goods R. The wall 20 includes a sidewall 21 having an inclined portion 21*a* and further includes a back wall 23 and a front wall 25 connecting both sidewalls 21 to guarantee storage and display stability (refer to FIGS. 2B and 5A).

As shown in FIGS. 5A and 2B, an entire panel p1 of the first box body P1 is illustrated in a cutting line view for manufacturing a packing box by using a Thomson mold, and a wall panel for wall portion 20 is connected to a central bottom panel p20.

Specifically, when a first back wall p23*a* and a second back wall p23*b* connected to a back end part of the bottom panel p20 are folded at a central folding line, a boss PB of an end of the second back wall is joined to a slit ps formed on a boundary line (a folding line), and the back wall 23 is standing.

When a first front panel p25*a* and a second front panel p25*b* connected to the front end part of the bottom panel p20 are folded at the central folding line, the boss pb formed at an end of an second front panel is coupled to the slot ps that is formed on a boundary line (a folding line) between the first front panel and the bottom panel.

Both sidewalls 21 are formed, in state of unfolding each first wing portion p21*c* at a side portion of the first back panel, and when a first side panel p21*a* and a second side panel p21*b* are folded, the boss pb of an end of the second side panel is inserted to stand on a slot ps on a side end of the bottom panel p20, whereby the first wing portion p21*c* and the first side panel p21*a* in contact each other are combined firmly through both joint member areas PB.

A second wing p21*d* of a front end of the first side panel p21*a* is inserted between the first front panel p25*a* and the second front panel p25*b* forming a front wall 25, thus the second wing and the second front panel are combined firmly by the joint member area PB formed on the second wing p21*d*.

Figure 4A:
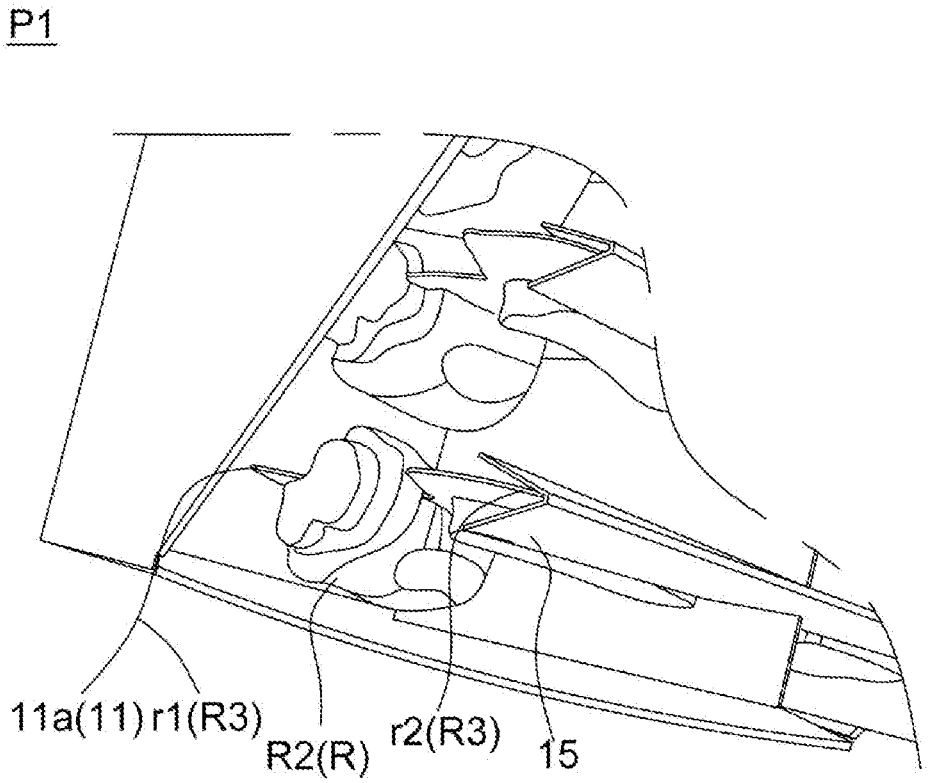
Figure 4B:
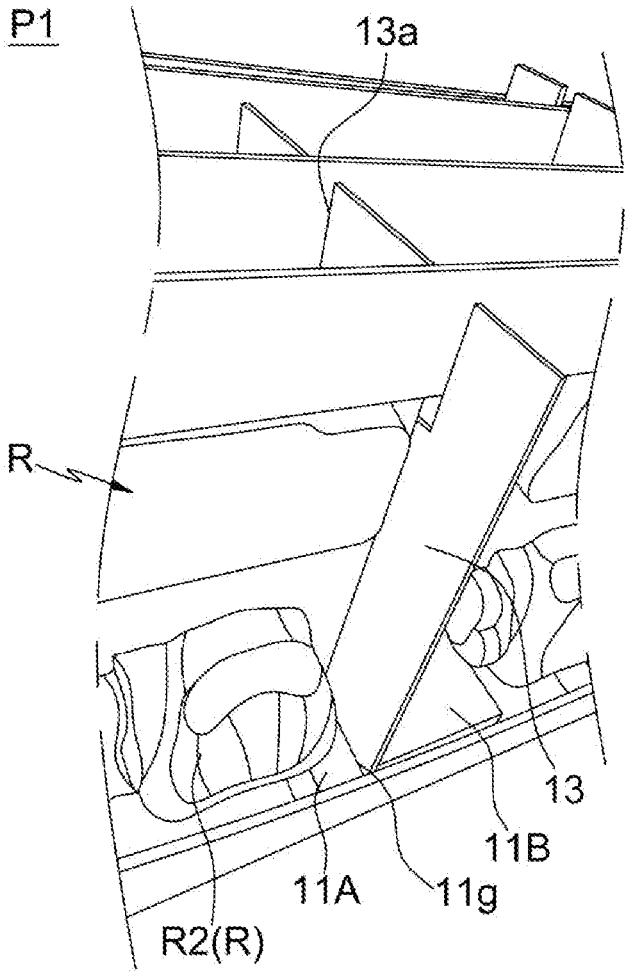
Figure 4C:
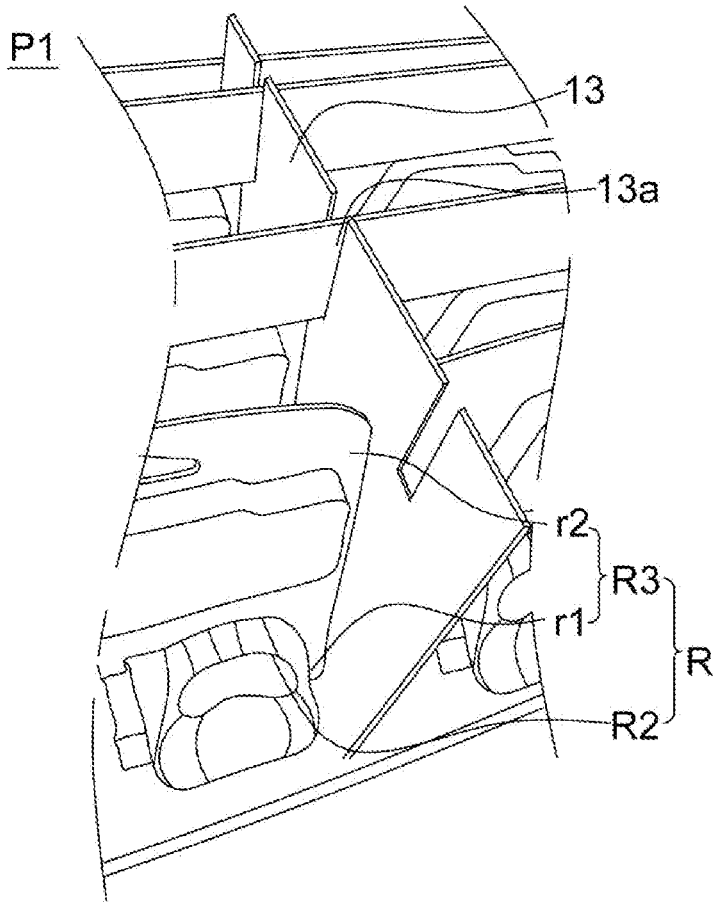

As shown in FIGS. 5B and 5C, the seat portion 11 of the first box body is formed effectively by a seat panel p11 placed on the bottom panel p20 on an assembly formed by folding and joining entire panel p1. Thus, the seat panel is placed in a state of being surrounded by the wall 20 in a state of folding as in an alternate long and short dashed ellipse on an upper portion. It is shown in FIG. 1A or 4C that three support panels are placed.

A more general description of a characteristics of the seat portion 11 is as follows: a plurality of seat portions 11 of the substrate 10 are arranged to form one set 11S in which multiple seat portions are arranged in front and rear parts of substrate (refer to FIG. 2C), and the seat portion sets are provided in left and right sides (three sets are provided in the figure).

Furthermore, it is preferable that a partition wall 13 is provided between the seat portion sets. This allows orderly and dense storage and display of goods.

FIGS. 5D, 5E, and 5F illustrate cutting line drawings that show a push panel p15 for a wedge panel 15, a partition panel p13 for the partition wall 13, and a lid panel pc for the first lid PC.

In addition, in the packing box for quick display according to the present invention, a cutoff slot 13*a* corresponding to the insert slit 11*a* of the seat portion 11 of a substrate 10 is formed on an upper portion of the partition wall 13 and the wall is set up with a lower end thereof inserted into the gap 11*g* between the set of seat portions 11S. Particularly, in a case of composing the seat portion by folding a seat panel phi, the cutoff slot 13*a* is joined with a wedge panel 15 covering an upper insert portion r2 of panel type external insert panels of packaged goods R. It is thus preferable to provide a function of preventing shaking, preventing mixing, and preventing collision of individually packaged goods during storage and transport thereof.

As shown in FIG. 5D, the wedge panel 15 is formed in a triangular shape by folding a central double folding line of a putting panel p15, whereby the wedge panel is configured to easily contain the upper insert portion r2 of the packaged good R having regular thickness by the double folding line.

The cutoff slot 13*a* of the partition wall 13 has a rectangular shape (alternatively, e trapezoidal shape may be possible), and the wedge panel 15 has a wedge shape in a state of contacting the upper insert portion r2 of the packaged good R. When the wedge panel 15 is raised due to various external forces, it is deformed in a shape by being widened, so that frictional force is generated in a form of being caught in the rectangular or trapezoidal cutoff slot, and thus storage stability of the packaged goods is increased.

Next, as described before, the first box body P1 further includes the first lid PC produced from the lid panel pc to increase storage stability. Particularly, when the packaged goods are fishing reels and, more specifically, when the packaged goods are individually packaged fishing reels, it is preferable that the packaging box has an asymmetric seat structure of the lower substrate suitable for the characteristics of the fishing reels having respective handles (refer to FIG. 2A).

Specifically in case that the packaged goods R are the fishing reels R1, as shown in FIGS. 1C, 2A, 3A, 3B, 4A, 4B, and 4C, each reel R1 is enclosed in a light transmissive case R2 with a handle Rh exposed outside, and a circumference of the light transmissive case is primary packaged with an external insert portion R3, especially, an external top r2 and a bottom insert portion r1 (composed of thick paper or other plate materials), in a state of being surrounded by the light transmissive case.

FIGS. 1C, 2A, and 5B show a configuration for a seat portion for a handle of a right hand use fishing reel, and FIGS. 3A, 3B, 4A, 4B, 4C, and 5C show a configuration for a handle of a left hand use fishing reel. As shown in the inside of the inner alternated long and short dashed ellipse of FIGS. 5B and 5C, on both sides of a central recess provided with a clamp C1, such as a synthetic resin, paper or metal clip type clamp, as required, only a slit 11*a* is formed on a short step 11A. Here, the slit 11*a* of the seat portion 11 is formed by a long hole p11*a* of the seat panel phi, and an extended flat portion is added to a long step 11B together with the slit 11*a* to have a seat portion of handle Rh.

In each drawing, a seat portion for a left or right hand use handle is provided, but the left and right hand use reels may be configured to be mixed as required.

FIG. 5B shows a right hand use seat panel p11R for a right hand use reel, FIG. 5C shows a left hand use seat panel p11L for a left hand use reel.

In the above description, a well-known technique related to a Thomson process, a cutting line, an assembling process of a sphere box body is omitted, but those skilled in the art can easily guess, deduce and reproduce it.

While the present invention has been particularly shown and described with reference to exemplary embodiments thereof, it is to be understood that the invention is not limited to the disclosed exemplary embodiments. It will be apparent to those skilled in the art that various modifications, and should be construed as falling within the scope of protection of the present invention.

What is claimed is:

1. A packing box for quick display, the packing box comprising:

a first box body including:

a lower substrate provided to pack goods each having a panel type external insert portion on each of upper and lower sides thereof, the lower substrate having a plurality of seat portions each having an insert slit in which a lower external insert portion of each of packaged goods is inserted; and a wall provided to surround an outside of the substrate, and including a sidewall having an inclined portion configured to expose the packaged goods, wherein the plurality of seat portions of the lower substrate are arranged to form a seat portion set in which multiple seat portions are arranged in front and rear parts of the lower substrate, the seat portion set being provided in two or more sets on left and right sides, with a partition wall provided between two neighboring seat portion sets, and wherein a cutoff slot corresponding to the insert slit is formed on an upper portion of the partition wall, and a wedge panel covering upper insert portions of the packaged goods is joined on the cutoff slot.

2. The packing box of claim 1, wherein a lower end of the partition wall is vertically inserted into a gap between the seat portion sets of the first box body.

3. The packing box of claim 1, wherein the cutoff slot of the partition wall has a rectangular or trapezoidal shape, the wedge panel has a wedge shape of a triangle, so that when the wedge panel is raised in a state of being in close contact with the upper insert portions of the packaged goods, the wedge panel is deformed by widening, the wall of the first box body includes a back wall connecting both sidewalls, the first box body includes a first lid which covers upper portions of the back wall and the sidewalls in a form of receiving the upper portions, and the packing box further includes an external second box body receiving the first box body and the first lid.

* * * * *